US006062620A

United States Patent [19]

Walker et al.

[11] Patent Number: 6,062,620

[45] Date of Patent: May 16, 2000

[54] SPREADER BAR

[75] Inventors: Steven D. Walker; Robert Yanniello, both of Arden; William Edward Wilkie, II, Fletcher, all of N.C.; Kenneth W. Tucker, Denison, Tex.; John H. Dileo, Pittsburgh, Pa.

[73] Assignee: Eaton Corporation, Clevland, Ohio

[21] Appl. No.: 09/139,679

[22] Filed: Aug. 25, 1998

[51] Int. Cl.[7] ..... B66C 1/28; B66C 1/66

[52] U.S. Cl. ..... 294/67.31; 294/67.5; 294/81.3; 294/81.51

[58] Field of Search ..... 294/67.31, 67.5, 294/68.3, 81.3, 81.51, 81.61

[56] References Cited

U.S. PATENT DOCUMENTS

| | | | |
|---|---|---|---|
| 2,844,404 | 7/1958 | Haugh et al. | 294/67.5 |
| 3,261,637 | 7/1966 | Bopp et al. | 294/67.31 |
| 3,972,553 | 8/1976 | Johnston | 294/81.3 |
| 3,995,903 | 12/1976 | Ernst | 294/81.3 |
| 4,626,012 | 12/1986 | Weldele | 294/81.3 |
| 5,324,088 | 6/1994 | Iio et al. | 294/68.3 |
| 5,820,184 | 10/1998 | Echenay | 294/81.3 |

FOREIGN PATENT DOCUMENTS

| | | | |
|---|---|---|---|
| 1632-919 | 3/1991 | U.S.S.R. | 294/81.51 |

OTHER PUBLICATIONS

Cutler–Hammer, I.B. 32–694A, Instructions for DSII Metal–Enclosed Low–Voltage Switchgear Assemblies with DSII Breakers, 4 pgs., Sep. 1996.

*Primary Examiner*—Dean J. Kramer
*Attorney, Agent, or Firm*—Martin J. Moran

[57] ABSTRACT

An apparatus for latching to any selected one of a family of electrical switching apparatuses having differently located centers of gravity includes a lifting bracket having a plurality of lifting attachment points whereby a crane or other hoisting device may be attached thereto. The lifting bracket with lifting attachment points enables the selected electrical switching apparatus to be lifted while being maintained generally level without excess tilting thereof. The apparatus also includes first and second latches movably connected to opposing ends of the apparatus for securely latching to the electrical switching apparatus being lifted. The lifting bracket of the apparatus also includes a locking flange for engaging the electrical switching apparatus during lifting and securely locking the first and second latches to the electrical switching apparatus.

15 Claims, 5 Drawing Sheets

SPREADER BAR

BACKGROUND OF THE INVENTION

1. Field of the Invention

The present invention relates to an apparatus for latching to any of a number of electrical apparatuses having differently located centers of gravity for the purpose of lifting the apparatus, particularly for installation in and removal from switchgear cabinets.

2. Background Information

Often, several electrical switching apparatuses, such as circuit breakers, network protectors, disconnect switches and transfer switches, are arranged in a stackable arrangement within a switchgear cabinet or similar electrical panel box. Typically, the switchgear cabinets are divided into cells having "draw-out rails" in which the electrical switching apparatuses, which may weigh several hundred pounds, are received for placement within the appropriate cell within the switchgear cabinet.

Usually it is necessary to utilize a mechanical lifting means, such as a crane, to lift or hoist the larger and heavier electrical switching apparatuses into the draw-out rails for placement within the switchgear cabinet. Furthermore, it is usually necessary to utilize an apparatus for attaching to the electrical switching apparatus being lifted which in turn may be connected to the crane for lifting. When utilizing such an apparatus for attaching to and lifting a particular electrical switching apparatus, it is important that the electrical switching apparatus remain generally level during lifting, i.e. without excess tilting. If not, then binding may occur when placing the electrical switching apparatus into the draw-out rails resulting in the electrical switching apparatus not being received in the proper position or orientation for placement within the switchgear cabinet. In addition, excess tilting or failure to maintain the electrical switching apparatus generally level during lifting may result in the electrical switching apparatus becoming disconnected from the apparatus attached thereto for lifting the same and possibly resulting in damage to the electrical switching apparatus or personal injury to workers overseeing the lifting operation.

One such known apparatus for attaching to the electrical switching apparatuses for lifting the same is referred to as a "spreader bar." The spreader bar employs conventional hooks on the ends thereof for attaching to and lifting electrical switching apparatuses, and is particularly well suited for attaching to electrical switching apparatuses having a metal frame or metal housing construction. For these type of apparatuses, a lift point is punched in the metal frame or metal housing. The lift point is punched at a location according to the size of the electrical switching apparatus, i.e., for different size apparatuses there is a difference in the weight distribution and thus a difference in the location of the center of gravity of the apparatuses. This enables the different apparatuses to be lifted while being maintained generally level without excess tilting thereof and thus reducing the possibility of improper placement in the switchgear cabinet or the apparatus becoming disconnected from the spreader bar.

While punching lift points in the metal frame or metal housing electrical switching apparatuses in order to attach the spreader bar thereto for even lifting works well and is convenient for these type apparatuses, this technique does not work well for electrical switching apparatuses having other types of frames or housings, such as, for example, a molded housing. For example, electrical switching apparatuses having a range of current ratings can be housed in a standardized molded housing resulting in apparatuses with differently located centers of gravity but with the same lifting points. Tooling limitations in constructing molded housing apparatuses prevent different lifting points being formed in the standardized molded housing for the apparatuses with a range of current ratings, thus necessitating that the same lifting points be used for all apparatuses. This results in the apparatus not being maintained generally level during lifting due to the differently located centers of gravity.

There is a need, therefore, identified for an apparatus for latching to electrical switching apparatuses for purposes of lifting the same, and particularly there is a need identified for an apparatus that is suitable for latching to electrical switching apparatuses having a molded housing construction.

There is a further need for such an apparatus that may be utilized with a family of circuit breakers having a range of current ratings.

There is also a need for such an apparatus that may be utilized for latching to any selected one of a family of electrical switching apparatuses having differently located centers of gravity such that the particular electrical switching apparatus being lifted may be maintained generally level, i.e., without excess tilting thereof.

There is an additional need for such an apparatus that may be easily latched to and unlatched from an electrical switching apparatus to be lifted.

There is yet a further need for such an apparatus that may be securely latched to an electrical switching apparatus so as to reduce the possibility of the electrical switching apparatus becoming disconnected therefrom during lifting.

SUMMARY OF THE INVENTION

These needs and others are satisfied by the present invention which is directed toward an apparatus, e.g., a spreader bar, for easily and reliably latching to electrical switching apparatuses for purposes of lifting the same. The apparatus is particularly well suited for latching to any selected one of a family of electrical switching apparatuses, such as, for example, circuit breakers, network protectors, disconnect switches and transfer switches, having differently located centers of gravity as a result of the family of electrical switching apparatuses having a range of current ratings. One important aspect of the apparatus is that the selected electrical switching apparatus being lifted may be maintained generally level without excess tilting thereof during the lifting operation. Another important aspect of the apparatus is that the electrical switching apparatus is maintained in a secure latching engagement with the apparatus latched thereto so as to prevent the electrical switching apparatus from being disconnected therefrom during the lifting operation.

The apparatus includes an elongated support member, having a first end and a second end, which acts as the main structural support of the apparatus. First latch means are movably connected to the first end of the elongated support member for latching to the electrical switching apparatus. Similarly, second latch means are movably connected to the second end of the elongated support member for also latching to the electrical switching apparatus. The apparatus further includes a lifting bracket connected to the elongated support member intermediate the first and second ends thereof. The lifting bracket may include a plurality of lifting attachment points whereby the electrical switching apparatuses having differently located centers of gravity may be lifted.

Preferably, the first and second latch means of the apparatus each include a latch member and mounting means for mounting each latch member to the elongated support member. The first and second latch means further include biasing means for biasing each of the latch members toward the elongated support member. In addition, each of the latch members include a hook portion having an elongated slot formed therein for latching to the selected electrical switching apparatus to be lifted. The electrical switching apparatus, which preferably has a molded housing construction, includes a downwardly depending flange that is received in the elongated slot formed on the hook portion of each of the latch members. Advantageously, this securely latches the apparatus to the electrical switching apparatus during lifting thereof.

Preferably, the lifting bracket is pivotally connected to the elongated support member and pivotable between a lifting position and a non-lifting position. In addition, the lifting bracket preferably has a locking flange which protrudes through an opening formed in the base of the elongated support member such that when the lifting bracket is in the lifting position, the locking flange is an engagement with the electrical switching apparatus for locking the apparatus to the electrical switching apparatus during lifting. Advantageously, this further secures the apparatus to the electrical switching apparatus to provide for added safety during lifting thereof.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
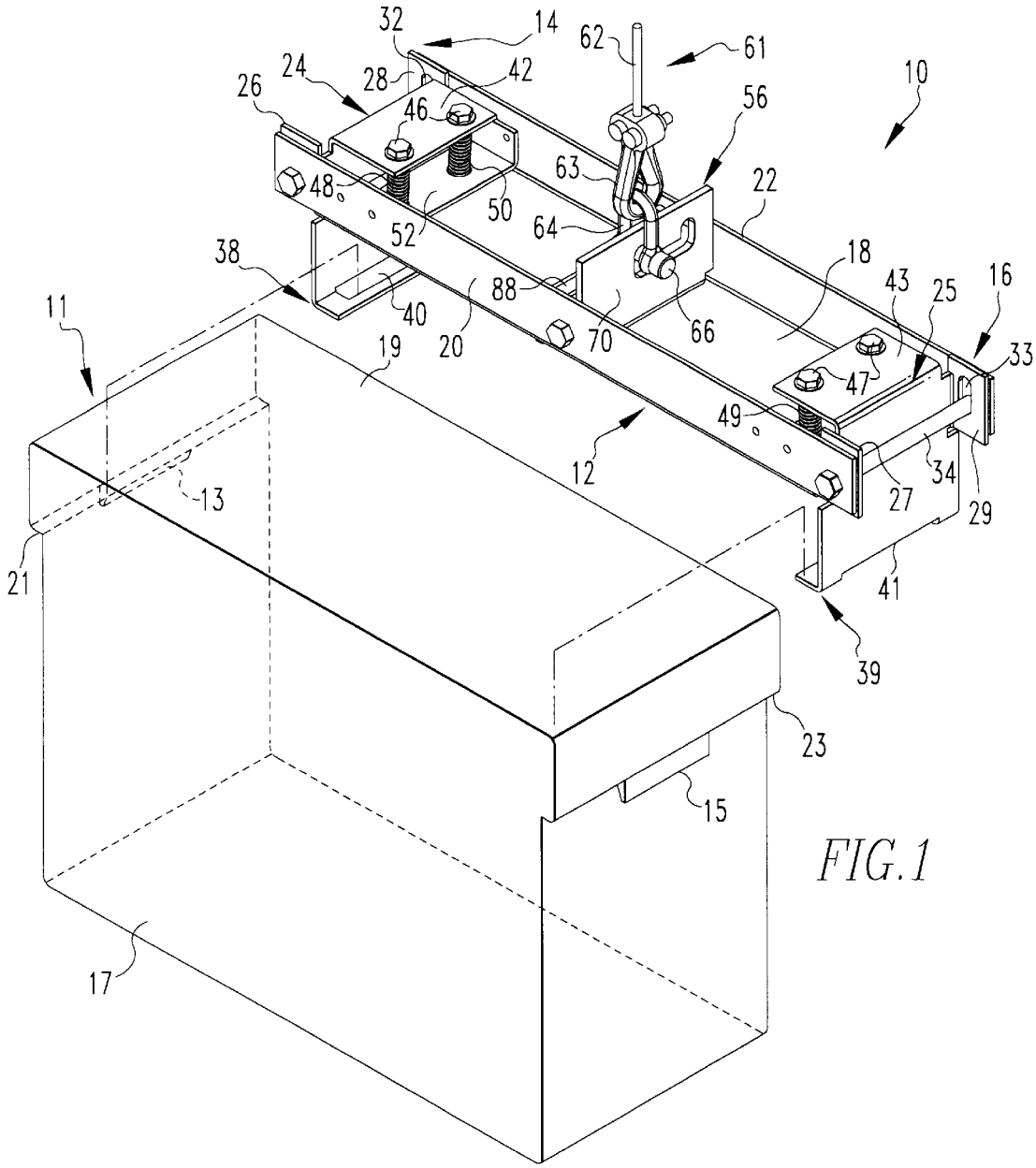
FIG. 1 is an isometric view of the apparatus, e.g., spreader bar, of the present invention for latching to the electrical switching apparatus, e.g., circuit breaker.
Figure 2:
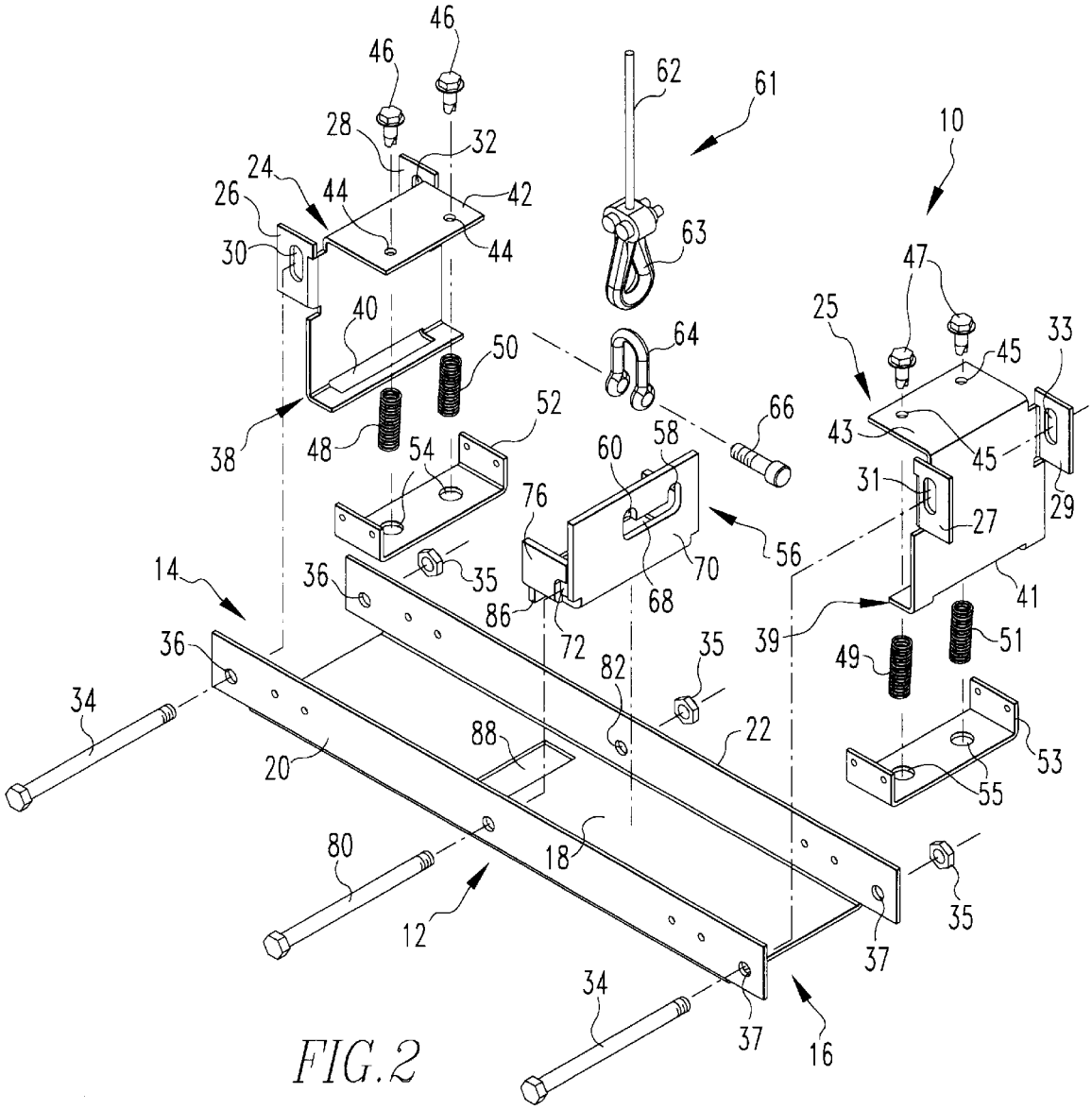
FIG. 2 is an exploded isometric view of the spreader bar of the invention.

Referring to FIGS. 1–2, there is shown a preferred embodiment of the apparatus or spreader bar 10 of the present invention. The spreader bar 10 is capable of latching to any selected one of a family of electrical switching apparatuses, such as circuit breakers, network protectors, disconnect switches and transfer switches having differently located centers of gravity, for lifting the electrical switching apparatuses while maintaining the same generally level without excess tilting thereof. The spreader bar 10 is particularly well suited for lifting electrical switching apparatuses having a molded housing wherein essentially the same shape of housing is used for a family of electrical switching apparatuses having a range of current ratings. As can be appreciated, as the current rating increases the weight distribution and the center of gravity of the apparatuses changes. This makes it increasingly difficult to lift the circuit breakers while maintaining the circuit breakers level without excess tilting thereof using spreader bars that are currently known in the art.

For purposes of illustration, the spreader bar 10 of the present invention will be described as used in conjunction for latching to a circuit breaker 11. However, it should be appreciated that the spreader bar 10 may be used in conjunction with other electrical switching apparatuses.

Still referring to FIGS. 1–2, the spreader bar 10 includes an elongated support member 12 having a first end 14 and a second end 16. The support member 12 acts as the main structural support of the spreader bar 10. The support member 12 may be of any suitable shape, but preferably is generally U-shaped in cross section having a base 18 along with a first side portion 20 and a second side portion 22 extending from the base 18.

The spreader bar 10 also includes a first latch means having a first latch member 24 that is movably connected to the first end 14 of the support member 12 for latching to circuit breaker 11, as will be described in more detail herein. For mounting the first latch member 24 to the elongated support member 12, the first latch member 24 includes a pair of flanges 26 and 28 extending therefrom. The pair of flanges 26 and 28 each include an elongated aperture 30 and 32, respectively, formed therein (see FIG. 2). A latch pin, such as bolt 34, extends through apertures 36 formed in the first and second side portions 20 and 22 of the elongated support member 12 and through the elongated apertures 30 and 32 formed on the flanges 26 and 28. A corresponding nut 35 is attached to the bolt for holding the same in position. Preferably, the elongated apertures 30 and 32 are vertically oriented with respect to the base 18 of the elongated support member 12. This provides the movable connection between the first latch member 24 and the elongated support member 12. However, it should be appreciated that essentially the same movable connection could be obtained if the vertically, elongated apertures were formed in the side portions 20 and 22 rather than on flanges 26 and 28.

The first latch member 24 further includes a hook portion 38 having an elongated slot 40 formed therein for latching to a downwardly depending flange 13 formed on circuit breaker 11. The downwardly depending flange 13 is preferably an extruded component formed on a handle 21 that extends at least partially along the side of the molded housing of the circuit breaker 11. By providing for the downwardly depending flange 13 to be received in the elongated slot 40, the circuit breaker 11 is prevented from sliding off of the hook portion 38, either in a fore and aft direction or in a lateral direction, during lifting. This more effectively provides for the lifting of a circuit breaker 11 having a molded housing construction.

The first latch member 24 also includes a top plate 42 having apertures 44 formed therein for receiving securing screws 46 which extend through the apertures 44 for securing biasing means, such as compression springs 48 and 50, to the first latch member 24. A spring support member 52 is attached within the support member 12 and includes a pair of spring openings 54 for receiving the other end of springs 48 and 50 for securing the same to the elongated support member 12. The securing screws 46 and the spring support member 52 maintain the springs 48 and 50 in the proper position during use of the spreader bar 10. Of course, it will be appreciated that other means, such as screws extending through base 18 of the elongated support member 12 or protrusions formed on base 18 may be used for maintaining the springs 48 and 50 in the proper position and securing the same to the elongated support member 12.

The spreader bar 10 further includes second latch means having a second latch member 25 that is movably connected to the second end 16 of the elongated support member 12 for latching to circuit breaker 11. The second latch member 25 is essentially identical to the first latch member 24, as described herein. Specifically, the second latch member 25 includes a pair of flanges 27 and 29 extending therefrom and having elongated apertures 31 and 33, respectively, formed therein. Bolt 34 is received through apertures 37 and the elongated apertures 31 and 33 for movably connecting the second latch member 25 to the elongated support member 12. Corresponding nut 35 is attached to the bolt 34 and secures the same in position.

The second latch member 25 also includes hook portion 39 having an elongated slot 41 formed therein for latching to another downwardly depending flange 15 formed on handle 23 of circuit breaker 11.

The second latch member 25 also includes a top plate 43 with apertures 45 extending therethrough for receiving securing screws 47. The securing screws 47 maintain compression springs 49 and 51 secured to the second latch member 25. Spring support member 53 is also provided and includes spring openings 55 for also securing the other end of springs 49 and 51 to the elongated support member 12.

Spring support member 52 and 53 may be secured to the elongated support member 12 by any suitable or appropriate means, such as screws, bolts or an adhesive (none of which are shown).

Figure 3:
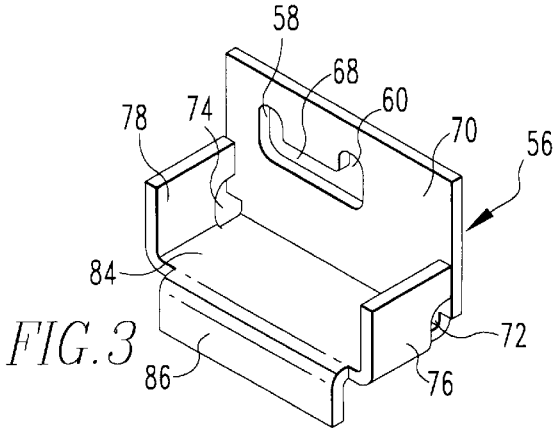
FIG. 3 is an isometric view of a lifting bracket of the spreader bar.

Referring to FIGS. 1–3, it can be seen that the spreader bar 10 further includes a lifting bracket 56 connected to the support member 12 intermediate the first end 14 and the second end 16 thereof. The lifting bracket 56 includes a plurality of lifting attachment points 58 and 60 whereby a known cable assembly 61 having a cable 62 with an eye 63 formed on the end thereof and having a shackle 64 attached thereto may be secured to the lifting points 58 or 60 by bolt 66 which extends through the shackle 64 in a manner as is generally known. The lifting points 58 and 60 are preferably formed in the lifting bracket 56 so as to be connected by slot 68. This allows for the bolt 66 to be easily moved back and forth between the attachment points 58 and 60 to allow for circuit breakers having differently located centers of gravity to be lifted.

The attachment points 58 and 60 are formed on a back member 70 of the lifting bracket 56. The back member 70 is positioned generally perpendicular to the longitudinal axis of the elongated support member 12 resulting in the attachment point 60 being closer to the front 17 of the circuit breaker 11 than is attachment point 58. Therefore, depending upon the weight distribution of the selected circuit breaker that the spreader bar 10 is to be attached to, attachment point 58 or 60 may be selected so as to maintain the circuit breaker generally level without excess tilting thereof during lifting. For example, circuit breakers having higher current ratings typically are heavier and have a different weight distribution due to the additional components and the size of components that are used to make the circuit breaker. Therefore, in the case of circuit breakers having higher current ratings the location of the center of gravity of that particular circuit breaker is likely to be closer to the back of the breaker. Thus, when attempting to lift such a circuit breaker, selection of attachment point 58 in the lifting bracket 56 would enable the circuit breaker to be maintained generally level during lifting thereof. Of course, for circuit breakers having lower current ratings and a different weight distribution, the center of gravity would most likely be located closer to the front of the circuit breaker. In this situation, selection of attachment point 60 of the lifting bracket 56 would enable the circuit breaker to be maintained generally level during lifting.

Of course, it will be appreciated that while attachment points 58 and 60 are shown and described herein, additional attachment points may be formed in the lifting bracket 56 to accommodate the lifting of a wide range of circuit breakers having differently located centers of gravity.

The lifting bracket 56 includes openings 72 and 74 formed in sides 76 and 78 thereof for receiving bolt 80 which extends through apertures 82 formed in the first and second side portions 20 and 22 of the support member 12 for pivotally connecting the lifting bracket 56 to the elongated support member 12. Cooperating nut 35 is provided for securing the bolt 80 to the support member 12. This results in the lifting bracket 56 being pivotable between a lifting position (see FIGS. 1 and 6) for lifting the circuit breaker 11 and a non-lifting position (see FIGS. 4 and 5) for disconnecting the cable assembly 61 from the lifting bracket or selecting a different attachment point for lifting.

The lifting bracket 56 also includes a bottom member 84 that is positioned adjacent the base 18 of the support member 12. A locking flange 86 extends generally perpendicularly from the bottom member 84 and through an opening 88 (see FIG. 3) that is formed in the base 18 of the support member 12. When the lifting bracket 56 is in the lifting position, as will be described in more detail herein, the locking flange 86 extends through the opening 88 and contacts the top 19 of the circuit breaker 11 so as to prevent the circuit breaker 11 from becoming disengaged or disconnected from the spreader bar 10 while lifting. As can be appreciated, the locking flange 86 is laterally offset from the bolt 80, which serves as a transverse pivot axis for the lifting bracket 56, such that rotation or pivoting of the lifting bracket 56 about bolt 80 creates a moment thereabout with the locking flange acting as a lever arm capable of asserting a greater force against the top 19 of circuit breaker 11.

Figure 4:
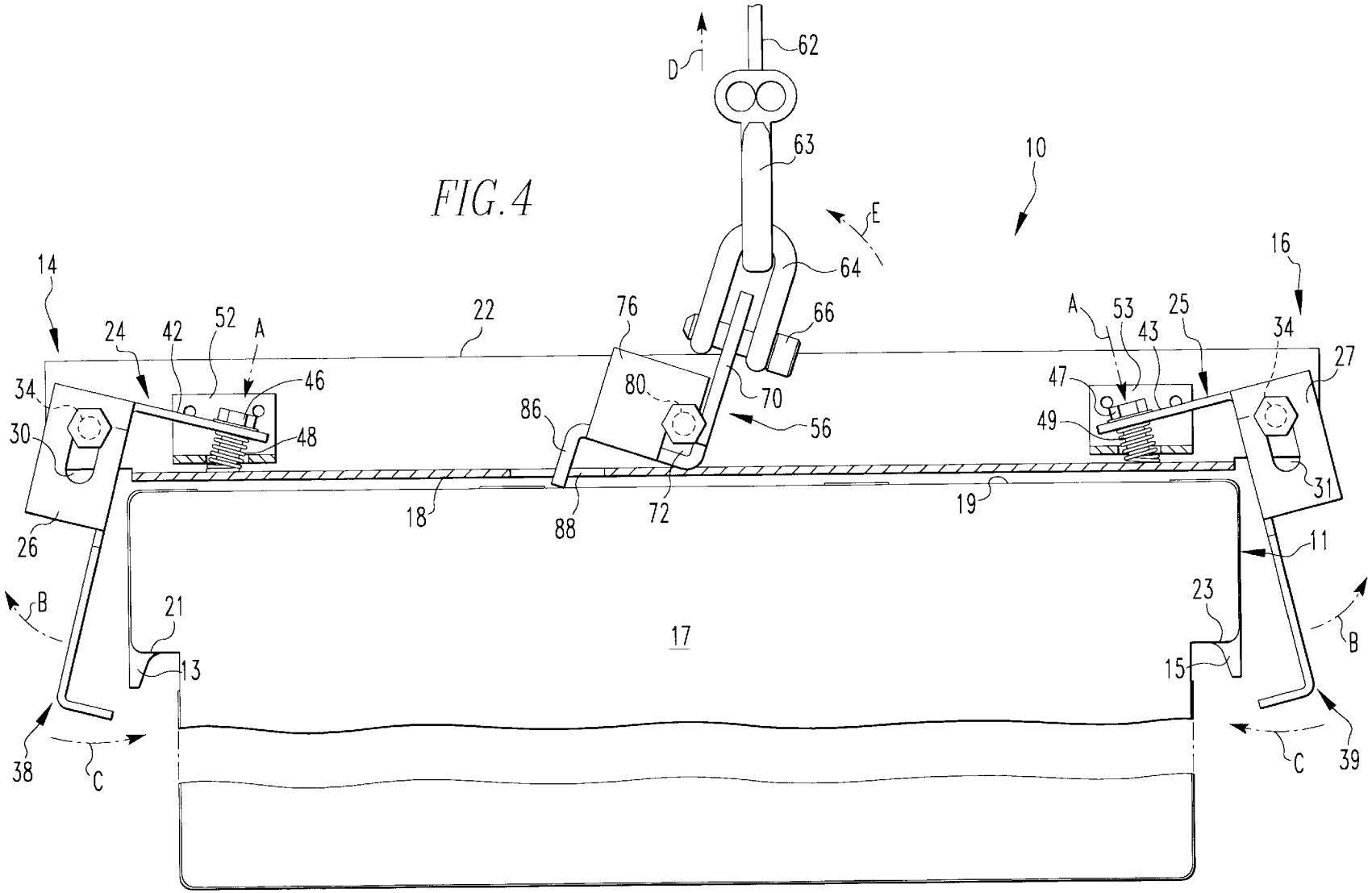
FIG. 4 is a front, partial sectional view of the spreader bar during latching or unlatching to the circuit breaker.
Figure 5:
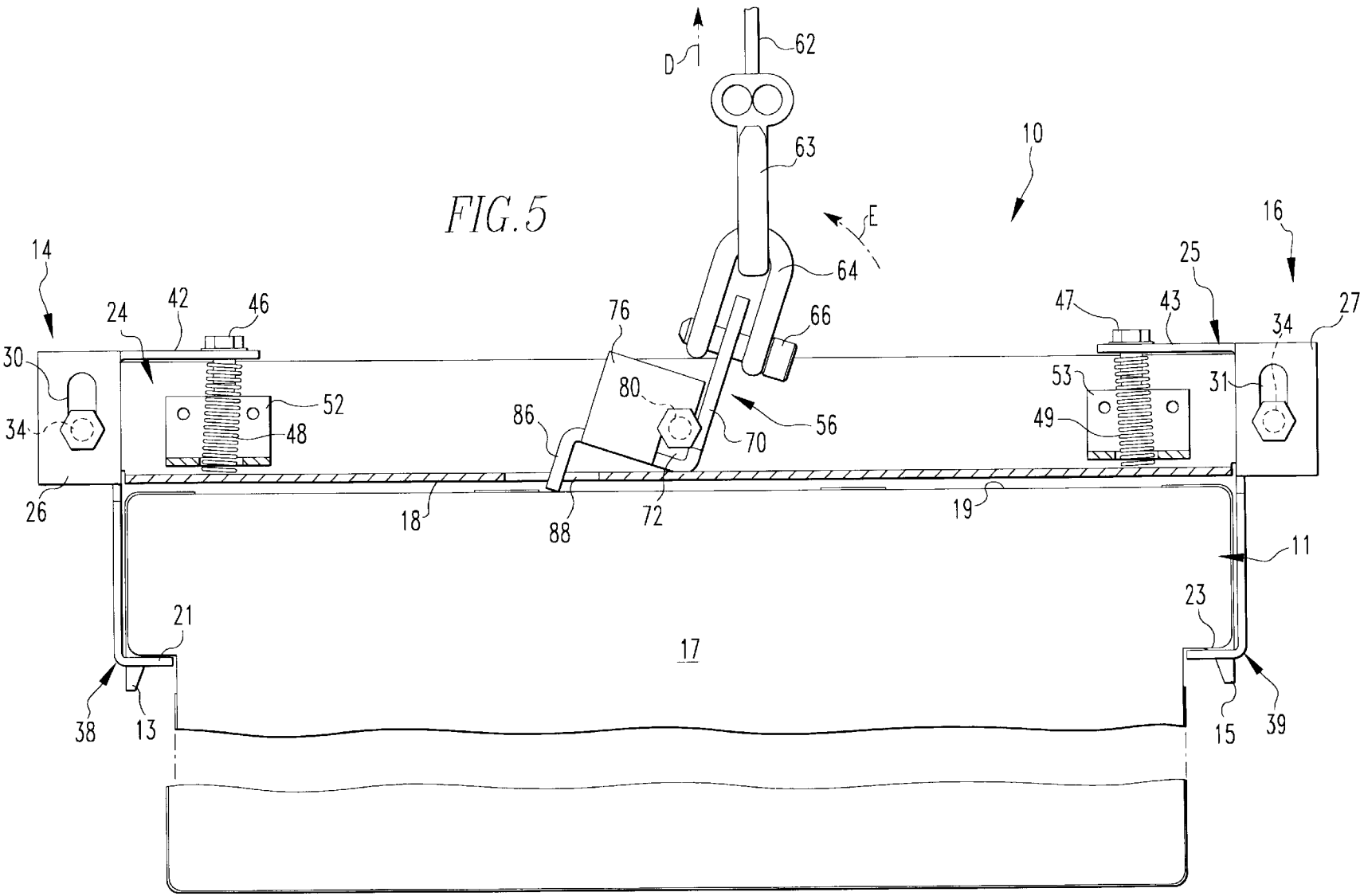
FIG. 5 is a front, partial sectional view of the spreader bar as latched to the circuit breaker.
Figure 6:
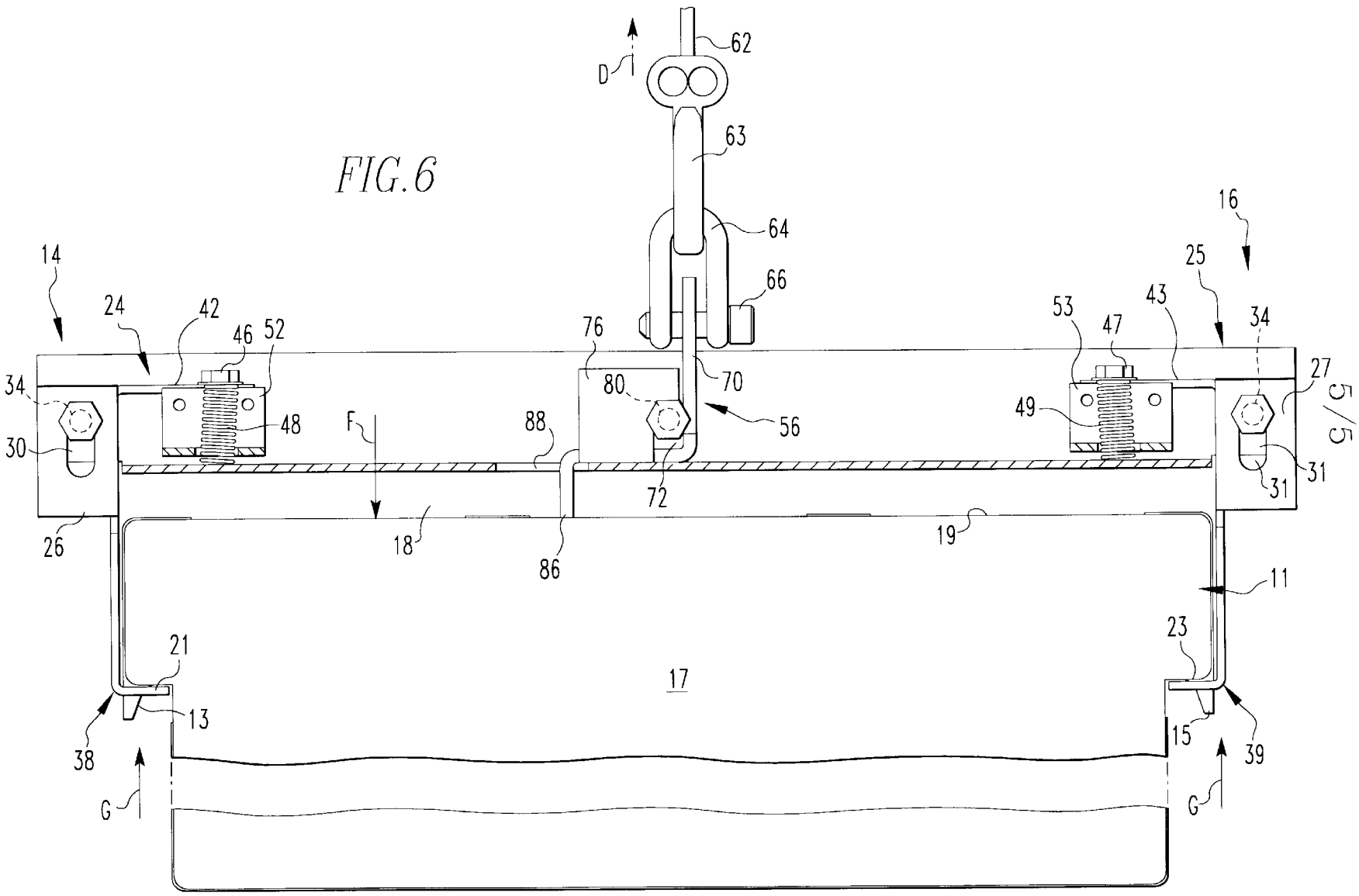
FIG. 6 is a front, partial sectional view of the spreader bar as latched to the circuit breaker and during lifting of the circuit breaker.

Referring to FIGS. 4–6, the operation of the spreader bar 10 will be explained in more detail. Based upon the weight distribution and location of the center of gravity of circuit breaker 11, or any other selected circuit breaker to be used in conjunction with the present invention, the bolt 66 of cable assembly 61 is positioned in either attachment point 58 or attachment point 60, as described herein. Of course, the selection of attachment point 58 or attachment point 60 is done while the lifting bracket 56 is in the non-lifting position (see FIGS. 4 and 5). While the lifting bracket 56 is in the non-lifting position, there is little or no tension in the cable 62.

Referring specifically to FIG. 4, the spreader bar 10 is shown as positioned on the top 19 of circuit breaker 11. In order to accommodate placement of the spreader bar 10 on the circuit breaker 11, the first latch member 24 and the second latch member 25 must be rotated about bolts 34 so that the hook portions 38 and 39 will clear the sides of the circuit breaker 11. This is accomplished by applying a force, in the direction of arrows A, to the top plates 42 and 43, while at the same time pulling the hook portions 38 and 39 in the direction of arrows B. During the application of the force in the direction of arrows A and the pulling motion in the direction of arrows B, springs 48 and 49, as well as springs 50 and 51 not shown in FIG. 4, are compressed toward the base 18 of the elongated support member 12. The hook portions 38 and 39 may then be easily positioned, by rotating the same in the direction of arrows C such that the elongated slots 40 and 41 are positioned directly beneath the downwardly depending flanges 13 and 15, respectively.

Referring to FIG. 5, discontinuing the application of the force in the direction of arrow A will then result in the first latch member 24 and the second latch member 25 being biased by the compression springs 48 and 50 and 49 and 51, respectively, toward the elongated support member 12. This results in the upward movement of the first latch member 24 and the second latch member 25 such that the downwardly depending flanges 13 and 15 formed on the circuit breaker 11 will be received within the elongated slots 40 and 41 of the hook portions 38 and 39, respectively. At this point, in the operation of the spreader bar 10, the spreader bar 10 is latched to circuit breaker 11 as a result of the downwardly depending flanges 13 and 15 being received in the elongated slots 40 and 41, respectively. In addition, the hook portions 38 and 39 are positioned for engagement with handles 21 and 23 for lifting of the circuit breaker 11.

In both FIGS. 4 and 5 the lifting bracket 56 is shown in the non-lifting position. Once a lifting force is applied in the direction of arrow D, the shackle 64 and bolt 66 are lifted upward resulting in the lifting bracket 56 rotating in the direction of arrow E about the bolt 80. As this occurs, and as shown in FIG. 6, the back member 70 is rotated to an essentially vertical position while the locking flange 86 also assumes a generally vertical position while continuing to protrude through the opening 88 formed in the base 18 of the elongated support member 12. The engagement between the locking flange 86 and the top 19 of the circuit breaker 11 results in a downwardly directed force being applied to the top 19. As this downwardly directed force is applied to the top 19 of the circuit breaker 11, the downwardly depending flanges 13 and 15 become firmly retained within the elongated slots 40 and 41 of the hook portions 38 and 39, respectively. In addition, the downwardly directed force applied by the locking flange 86 also causes the first latch member 24 and the second latch member 25 to move in a downwardly direction. The first latch member 24 and the second latch member 25 moving downward causes the compression springs 48 and 50 and compression springs 49 and 51, respectively, to be compressed downward. As the cable 62 is raised, the elongated support member 12 is lifted further compressing the springs 48 and 50, as well as springs 49 and 51, until bolts 34 reach the top of elongated apertures 30 and 32 and 31 and 33. Therefore, it will be appreciated that as the cable 62 continues to be lifted in the direction of lifting force D, the locking flange 86 is applying a downward force in the direction of arrow F while the hook portions 38 and 39 are applying an upward force in the direction of arrow G to the circuit breaker 11. The net result of the downward force in the direction of arrow F and the upward force in the direction of arrow G is that the circuit breaker 11 is locked into latching engagement with the spreader bar 10. With the downwardly depending flanges 13 and 15 being received in the hook portions 38 and 39, respectively, and the opposing forces in the direction of arrows F and G acting on the circuit breaker 11, the circuit breaker 11 will not become disconnected from the spreader bar 10 during lifting.

In order to disconnect and remove the spreader bar 10 from the circuit breaker 11, the operation of latching to and lifting the circuit breaker 11, as described herein, is performed in essentially the reverse manner. For example, once the circuit breaker 11 is placed onto the desired surface, the tension in cable 62 is no longer being applied in the direction of arrow D, therefore allowing the lifting bracket 56 to pivot back to the non-lifting position. In addition, disengagement of the locking flange 86 or discontinuing application of the force by locking flange 86 on the top 19 of circuit breaker 11 allows the first latch member 24 and the second latch member 25 to once again be biased toward the elongated support member, as shown in FIG. 5. Next, the first latch member 24 and the second latch member 25 may be depressed and then pivoted about the bolts 34, as shown in FIG. 4 in order to release the hook portions 38 and 39 from the downwardly depending flanges 13 and 15 respectively.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An apparatus for latching to any selected one of a family of electrical switching apparatuses having differently located centers of gravity comprising:

elongated support member having a first end and a second end;

first latch means connected to said first end of said elongated support member for latching to the electrical switching apparatuses;

second latch means connected to said second end of said elongated support member for latching to the electrical switching apparatuses;

a lifting bracket connected to said elongated support member intermediate said first and second ends thereof and having a plurality of lifting attachment points through which any selected one of the family of electrical switching apparatuses having differently located centers of gravity may be lifted utilizing one of the plurality of lifting attachment points; and wherein, said lifting bracket is pivotally connected to said elongated support member and pivotable between a lifting position and a non-lifting position.

2. The apparatus of claim 1 wherein said first and second latch means each include a latch member and mounting means for mounting each said latch member to said elongated support member.

3. The apparatus of claim 2 wherein said first and second latch means each further include biasing means for biasing each said latch member toward said elongated support member.

4. The apparatus of claim 3 wherein said mounting means includes elongated apertures formed in one of said elongated support member and each said latch member; and said mounting means further including latch pins extending through said elongated apertures for movably connecting each said latch member to said elongated support member.

5. The apparatus of claim 4 wherein each said latch member is rotatable about said latch pins.

6. The apparatus of claim 5 wherein each said latch member includes a pair of flanges extending therefrom, each said pair of flanges having said elongated apertures formed therein.

7. The apparatus of claim 3 wherein each said latch member includes a hook portion having an elongated slot formed therein for latching to the selected electrical switching apparatus.

8. The apparatus of claim 7 wherein said elongated support member includes a base having an opening formed therein adjacent said lifting bracket; and said lifting bracket includes a locking flange which protrudes through said opening for engagement with the selected electrical switching apparatus when said lifting bracket is in said lifting position causing each said latch member to be biased away from said elongated support member for securely locking said hook portions of the apparatus to the selected electrical switching apparatus during lifting.

9. The apparatus of claim 3 wherein said first and second latch means each further include first securing means for securing said biasing means thereto and second securing means for securing said biasing means to said elongated support member.

10. An apparatus for latching to any selected one of a family of electrical switching apparatuses having differently located centers of gravity comprising:

elongated support member having a first end and a second end;

first latch means connected to said first end of said elongated support member for latching to the electrical switching apparatuses;

second latch means connected to said second end of said elongated support member for latching to the electrical switching apparatuses;

a lifting bracket connected to said elongated support member intermediate said first and second ends thereof and having a plurality of lifting attachment points through which any selected one of the family of electrical switching apparatuses having differently located centers of gravity may be lifted utilizing one of the plurality of lifting attachment points;

said first and second latch means each include a latch member and mounting means for mounting each said latch member to said elongated support member;

said first and second latch means each further include biasing means for biasing each said latch member toward said elongated support member; and said lifting bracket includes locking means which engages the electrical switching apparatus causing each said latch member to be biased away from said elongated support member for securely locking each said latch member to the electrical switching apparatus during lifting.

11. An apparatus for latching to an electrical switching apparatus comprising:

an elongated support member having a first end and a second end;

first latch means movably connected to said first end of said elongated support member for latching to the electrical switching apparatus;

second latch means movably connected to said second end of said elongated support member for latching to the electrical switching apparatus;

said first and second latch means each including a latch member and mounting means for mounting each said latch member to said elongated support member;

said first and second latch means each further include biasing means for biasing each said latch member toward said elongated support member;

lifting attachment means connected to said elongated support member intermediate said first and second ends thereof whereby the electrical switching apparatus may be lifted;

said mounting means includes elongated apertures formed in one of said elongated support member and each said latch member; and said mounting means further including latch pins extending through said elongated apertures for movably connecting each said latch member to said elongated support member.

12. The apparatus of claim 11 wherein each said latch member is rotatable about said latch pins.

13. The apparatus of claim 12 wherein each said latch member includes a pair of flanges extending therefrom, each said pair of flanges having said elongated apertures formed therein.

14. An apparatus for latching to an electrical switching apparatus comprising:

an elongated support member having a first end and a second end;

first latch means movably connected to said first end of said elongated support member for latching to the electrical switching apparatus;

second latch means movably connected to said second end of said elongated support member for latching to the electrical switching apparatus;

a lifting bracket connected to said elongated support member intermediate said first and second ends thereof; and said lifting bracket having an attachment end and a locking end where said lifting bracket is pivotable about a transverse pivot axis between a lifting position and a non-lifting position, such that pivoting of said lifting bracket to said locking position results in said locking end pivoting about said transverse pivot axis for engagement with the electrical switching apparatus and applying a force thereto causing each said first and second latch means to be biased away from said elongated support member for securely locking said first and second latch means to the electrical switching apparatus during lifting.

15. The apparatus of claim 14 wherein said elongated support member includes a base having an opening formed therein adjacent said locking end of said lifting bracket; and said locking end includes a locking flange that is laterally offset from said transverse pivot axis and protrudes through said opening for applying the force to the electrical switching apparatus when said lifting bracket is in said lifting position.

* * * * *